United States Patent [19]

Primault

[11] 4,020,195

[45] Apr. 26, 1977

[54] METHOD FOR ENAMELLING THE EDGES OF SANITARY ARTICLES

[75] Inventor: André Primault, Garches, France

[73] Assignee: Societe Generale de Fonderie, Paris, France

[22] Filed: May 30, 1975

[21] Appl. No.: 582,239

Related U.S. Application Data

[63] Continuation-in-part of Ser. No. 361,608, May 18, 1975, Pat. No. 3,904,128.

[30] Foreign Application Priority Data

June 27, 1972 France ..... 72.23187

[52] U.S. Cl. ..... 427/193; 427/196; 427/314; 427/318; 427/424; 427/425; 427/427

[51] Int. Cl.[2] ..... B05D 3/02; B05D 1/34

[58] Field of Search ..... 427/196, 193, 424, 425, 427/427, 314, 318; 239/587; 118/308, 323

[56] References Cited

UNITED STATES PATENTS

| | | | |
|---|---|---|---|
| 525,487 | 9/1894 | Crawford | 239/587 X |
| 1,128,175 | 2/1915 | Morf | 427/422 |
| 1,311,261 | 7/1919 | Braselton | 427/422 X |
| 1,654,509 | 12/1927 | Claus | 427/422 X |
| 2,022,750 | 12/1935 | Toohey | 427/422 X |
| 2,129,471 | 9/1938 | Juengst | 239/587 X |
| 2,139,628 | 12/1938 | Terry | 239/587 X |
| 2,288,101 | 6/1942 | Mayer | 239/587 X |
| 2,889,083 | 6/1959 | Schwinhorst | 118/308 X |
| 2,986,336 | 5/1961 | Sharky | 239/587 X |
| 3,058,443 | 10/1962 | Paton | 118/308 X |
| 3,294,058 | 12/1966 | Shriro | 118/323 X |
| 3,546,909 | 12/1970 | Gartrell | 427/193 X |
| 3,716,021 | 2/1973 | Fry | 118/308 |

*Primary Examiner*—Ronald H. Smith
*Assistant Examiner*—Shrive P. Beck
*Attorney, Agent, or Firm*—Young & Thompson

[57] ABSTRACT

An enamel flux supplied by a sieve carried by an articulated support is discharged under gravity onto the edge of a displaceably mounted sanitary article such as a bath or wash-basin in such a manner as to form a projecting portion which is turned-down against the lateral surface of the edge by means of a jet of gas which is directed transversely by a positionally-adjustable nozzle.

3 Claims, 6 Drawing Figures

A
B
1
3
4
5
5a
8
11
12
12a
13
13a
14
14a
15
16
17
18
21
22
23
24
25
26
27
28
41
42
Y
Y'
Z-Z'

METHOD FOR ENAMELLING THE EDGES OF SANITARY ARTICLES

This application is a continuation-in-part of my previous patent application filed May 18, 1973, Ser. No. 361,608. now U.S. Pat. No. 3,904,128 dated Sept. 9, 1975.

This invention relates to a method for enamelling edges of sanitary articles such as baths, wash-basins and the like.

A known method of enamelling articles of this type is carried out in the dry state by deposition of enamel powder on the object to be enamelled which has previously been heated to a temperature above the melting temperature of the enamel. When coming into contact with the object, the enamel melts and forms a coating which hardens during cooling of the object.

It is endeavored in practice to place the surface of the object in a position close to the horizontal in order to receive the enamel powder which is deposited in a layer by means of a dusting device such as a sieve. The grains of enamel thus come into contact with the surface of the article in a direction which is substantially at right angles to said surface. Said grains then melt immediately without sliding over the article considered and this is conducive to uniform thickness of the enamel coating.

This method is also carried out by means of other known devices such as those described in particular in French Pat. No. 1,590,113 of Apr. 12, 1968 and No. 69,31,154 of Sept. 12, 1969 in the name of the present Applicant.

In point of fact, the edge of sanitary articles and especially baths usually has a lateral surface which is joined to the remainder of the edge by a rounded surface. This lateral surface must be coated with enamel to the same extent as the remainder of the edge.

In practice, said lateral surface is enamelled at the same time as the remainder of the edge but it cannot in that case be presented at right angles to the jet of enamel powder.

Irregularities consequently occur in the distribution of enamel and these affect the quality of the finished article.

The method of enamelling to which the present invention is primarily directed makes it possible to obtain articles which do not exhibit these imperfections.

In accordance with the invention, the method for enamelling the edges of sanitary articles such as baths in which enamel is dusted from a dusting unit in the vicinity of the edge to be enamelled, is characterized in that an enamel flux is caused to fall onto the edge so as to project therefrom and wherein the projecting portion of said flux is turned down towards the lateral surface of the edge by blowing towards said edge a jet of gas which is directed transversely with respect to said lateral surface and intersects or passes in the vicinity of the vertical center-line of said dusting unit and below the latter, so as to substantially intersect the flow of enamel dust when said dusting unit is operated.

The blast thus produced has the effect of directing the enamel powder towards the lateral surface along a path having a velocity component which is perpendicular to said surface, thereby preventing the powder from sliding thereon and ensuring uniform distribution.

In a preferred embodiment of the method, the jet of gas is blown through a nozzle and the flow velocity of said jet is regulated as a function of the distance between the outlet of the nozzle and the surface to be enamelled.

By reason of the irregularity of the contour of some sanitary articles, the distance between the nozzle outlet and the surface to be enamelled can in fact vary during the rotation of the article. In the case of articles of this type, it can accordingly be an advantage to increase or decrease the gas flow rate during the enamelling operation according as the nozzle outlet is located at a greater or smaller distance from the surface to be enamelled.

The grains of enamel powder thus come into contact with the article at a constant velocity, thereby improving the quality of the enamel coating to an even greater extent.

Further properties and advantages of the invention will become apparent from the detailed description which is given hereinafter, reference being made to the accompanying drawings which are given by way of example and not in any limiting sense, and wherein.

Figure 1:
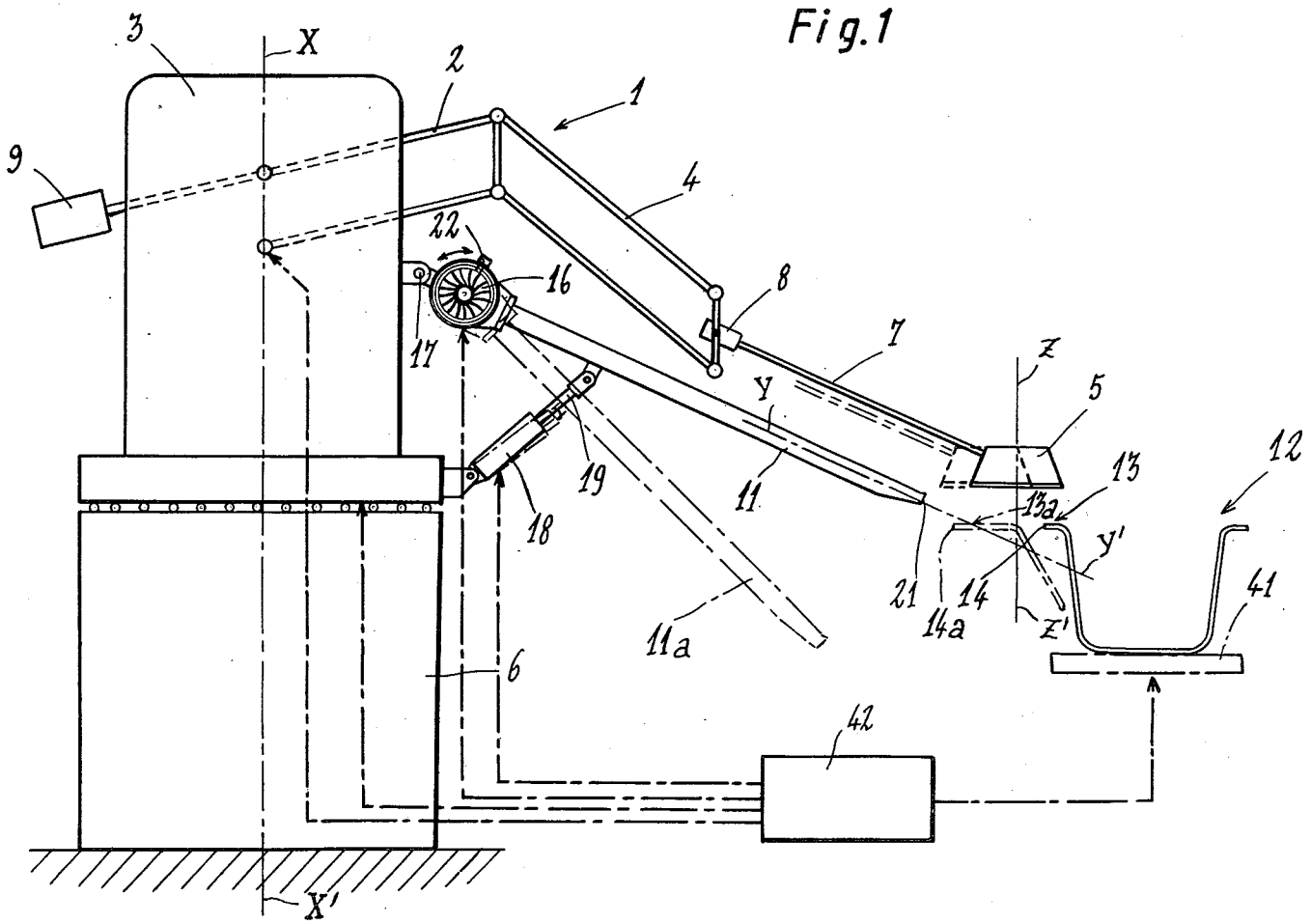
FIG. 1 is a diagram of one embodiment of a device adapted to carry out the method for enamelling according to the invention, applied to the enamelling of a bath.
Figures 2, 6:
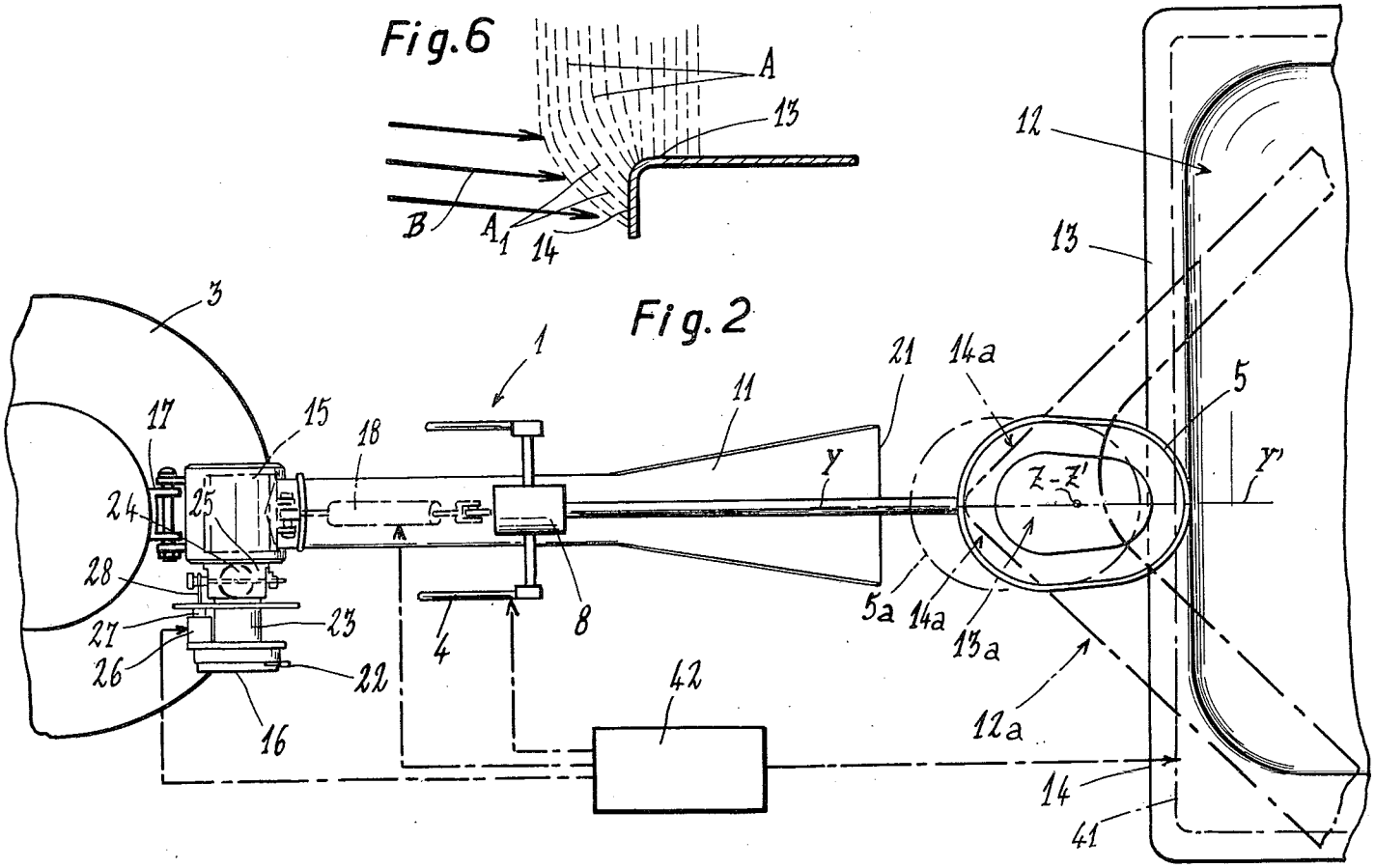
FIG. 2 is a fragmentary top view to a larger scale showing the device of FIG. 1.
FIG. 6 shows the respective paths followed by the enamel powder and the gas jet in the vicinity of the edge to be enamelled.

The device which is shown in FIGS. 1 and 2 comprises a support for a dusting unit constituted by a sieve 5 as has already been disclosed in the above-cited French Pat. No. 1,590,113. Said support comprises an articulated and deformable frame 1 and a turret 3. The supporting frame 1 comprises a boom 2 which is pivotally mounted on the turret 3 and a fore-boom 4 which carries the sieve 5. The turret is mounted on a base 6 so as to be capable of rotation about its axis X-X'.

The sieve 5 is carried by an arm 7 on which is fixed a vibrator 8, although other means can evidently be provided for dusting the enamel. A balance-weight 9 is fixed at the extremity of the extension of the boom 2. The support for the sieve 5 is such that this latter remains continuously in a substantially horizontal position.

A blowing nozzle 11 is pivotally mounted on the turret 3 and connected to means described hereinafter for producing a gas stream which passes through said nozzle.

In the example herein described, the sanitary article to be enamelled is a bath 12 which is placed horizontally on an orientable table of known type as represented diagrammatically at 41. Said table is capable of carrying out movements of rotation about a vertical axis and movements of horizontal translation so that the entire edge 13 of the bath 12 and its external lateral surface 14 passes beneath the sieve 5.

The bath-supporting table 41 can advantageously be of the type described in French Pat. No. 69,08,838 of March 26, 1969 in the name of the present Applicant.

The nozzle 11 is equipped with a fan 15 (shown in FIG. 2) for blowing gas and is pivoted on the turret 3 about a substantially horizontal pin 17. The fan 15 is of the impeller type, for example.

Said nozzle 11 is so arranged with respect to the turret 3 and the supporting frame 1 that the axis Y–Y′ of said nozzle intersects the vertical axis Z–Z′ of the sieve 5 or passes in the vicinity of this latter.

The gas which is blown into the nozzle is preferably air but another gas such as nitrogen can be employed without departing from the scope of the invention.

The angular position of the nozzle 11 with respect to the support frame 1 which carries the sieve 5 is adjustable by means of a jack 18 which is mounted in the same manner as a strut and pivotally connected at one end to the nozzle 11 and at the other end to the base of the turret 3.

The nozzle 11 is in the top position when the operating rod 19 of the jack 18 is in the outwardly extended position whereas said nozzle is in the bottom position 11a when the operating rod 19 is withdrawn. In this example, the angle between the two end positions of the nozzle 11 is approximately 30 degrees.

Means are provided for regulating the flow rate of the gas which is blown through the nozzle 11. Said means comprise an iris-type diaphragm 16 which is mounted at the inlet of a duct 23 through which air is admitted into the nozzle 11. The aperture of said diaphragm can be adjusted manually by means of a control knob 22 (as shown in FIG. 2). The means considered further comprise a circular butterfly-gate 24 which serves to control the air flow rate and is placed within the duct 23 between the diaphragm 16 and the fan 15.

Figure 4:
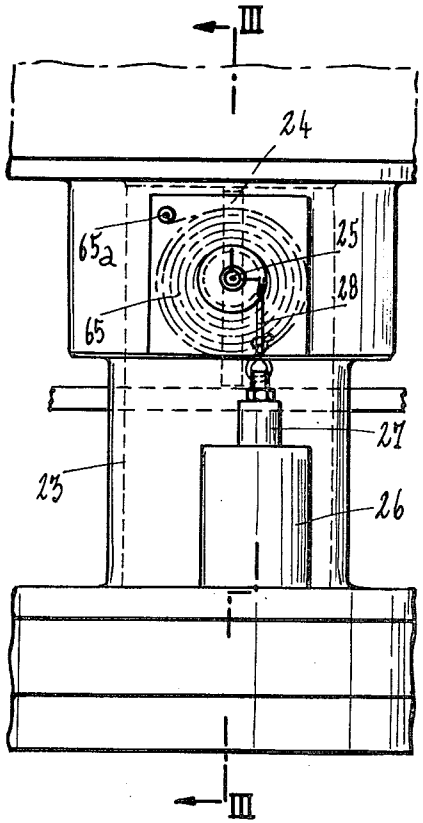
FIGS. 4 and 5 are views in side elevation showing the regulating means of FIG. 3.
Figure 3:
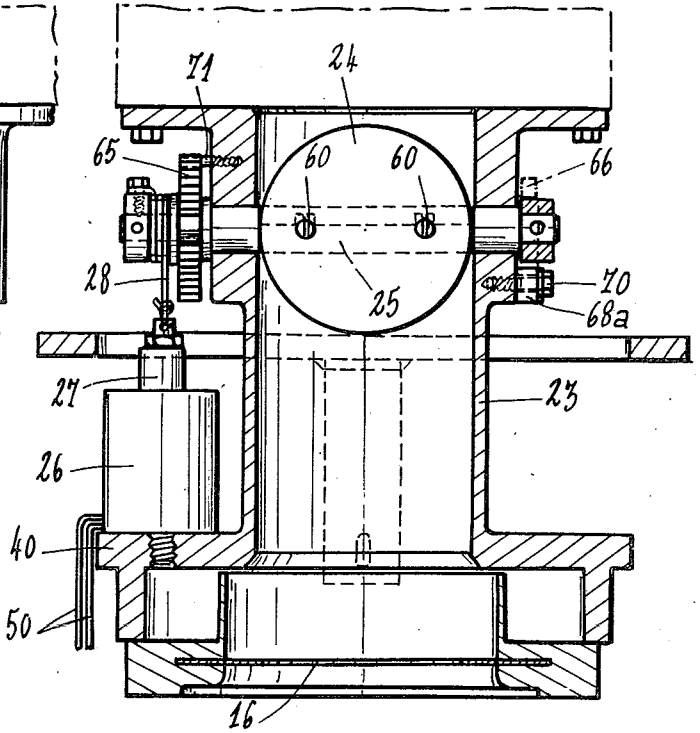
FIG. 3 is a sectional view to a larger scale showing means for regulating the gas flow, this view being taken along line III-III of FIG. 4.
Figure 5:
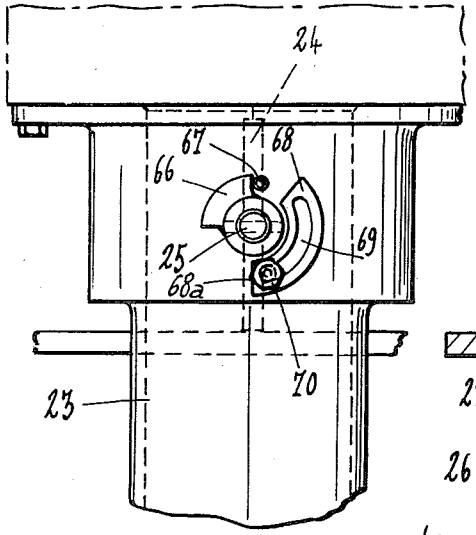

Referring more particularly to FIGS. 3 to 5, it is apparent that said butterfly-gate 24 is mounted diametrically on a rotary positioning rod 25 which is placed transversely with respect to the duct 23.

The butterfly-gate 24 is fixed to said rod 25 by means of two screws 60; a cord 28 is wound around one end of said rod 25 and connects this latter to a sliding armature 27 located within the air-gap of an electromagnet 26 which is fixed on an annular flange 40 fo the duct 23.

The cord 28 is preferably formed of plastic material and the electromagnet 26 is connected by means of leads 50 to a current supply which is not shown in the drawings.

The armature 27 is capable of sliding within the electromagnet 26 when this latter is energized and of causing the rod 25 and the butterfly-gate 24 to rotate by means of the connecting cord 28.

A cam 66 is rigidly fixed for rotation at one end of the rod 25 and is maintained by a spiral spring 65 against a fixed stop 67 which is mounted on the duct 23.

The spring 65 is placed around the rod 25 at that end of this latter which is remote from the cam 66 and is applied against the body of the duct 23 by a screw 71 to which is attached the end **65*a* of the spring 65.**

A circular sector 68 (as shown in FIG. 5) having a cavity 69 is placed opposite to the cam 66 with respect to the rod 25. Said sector 68 is held in position by a bolt 70 which is passed through the cavity 69 and screwed into the wall of the duct 23, that extremity **68*a* of said sector 68 which is remote from the fixed stop 67 being intended to serve as an adjustable stop for the cam 66.**

In order to limit the rotation of the cam 66 and therefore of the butterfly-gate 24, it is only necessary to unscrew the bolt 70 and to cause the sector 68 to rotate until the desired position is reached by bringing the extremity **68*a* closer to the cam 66.**

As is apparent from FIG. 5, it is thus possible to limit the rotation of the cam 66 to a maximum angle of 90°; this value corresponds to complete closure of the duct 23 by the butterfly-gate 24.

In the example which is illustrated, the edge of the bath 12 has a lateral surface 14, the width of which is 1 to 2 cm approximately, depending on the type of bath.

The distance between said surface 14 and the outlet 21 of the nozzle 11 remains constant when the displacement of the bath 12 corresponds to translational motion in the direction of its longest side but this distance decreases when a movement of rotation of the bath is initiated so as to bring one end of this latter into position vertically beneath the sieve 5.

On completion of a movement of rotation through an angle of 45 degrees, the bath takes up the position **12*a* (FIG. 2). As shown in this figure, that surface of the edge 13*a* which is located beneath the sieve 5 is then much larger and the corresponding lateral surfaces 14*a* are much closer to the nozzle 11.**

In order to take this modification into account, the sieve 5 is moved backwards to position **5*a*** in synchronism by manual or mechanical control means in order that the surfaces to be enamelled should be maintained vertically beneath the sieve in an accurate manner.

In accordance with one of the characteristic features of the invention, it is proposed to regulate the rate of flow of air which is blown through the nozzle 11 as a function of the distance between the outlet orifice of said nozzle and the surface 14 to be enamelled, said rate of flow being intended to vary in direct proportion to the distance. This adjustment can be performed by hand but is preferably carried out automatically. In this case, the programming unit 42 which controls the correlative displacements of the bath-supporting table 41 and the articulated frame 1 in known manner is also intended to control the excitation of the electromagnet 26. These connections are represented diagrammatically in FIGS. 1 and 2 by chain-dotted lines which start from the unit 42. There are thus shown the control connections which are established between said unit and the jack 18 as well as those which terminate at the position-control elements of the turret 3 and the articulated frame 1.

Within the field of application of the device as thus constructed, the method according to the invention is carried out as follows:

Prior to beginning of the enamelling operation, the operating rod 19 of the jack 18 is withdrawn, the nozzle 11 is in the bottom position **11*a* and the fan 15** is stationary.

The jack 18 is then actuated so as to bring the nozzle 11 into the service position by rotating this latter through an angle of approximately 30° about the pivot-pin 17. The aperture of the diaphragm 16 is then adjusted to the appropriate value by means of the manual control knob 22. Since the electromagnet 26 is not energized, the butterfly-gate 24 is parallel to the axis of the duct 23 in the position of maximum flow.

The bath 12 is then displaced in horizontal translational motion in a direction parallel to its longest side; at the same time, an enamel flux A (as shown in FIG. 6) which is distributed by the sieve 5 is allowed to fall onto the edge 13 in such a manner as to project outwards from the bath with respect to the vertical line of extension of the lateral surface 14 of the edge 13. The fan 15 is also put into operation.

The air is drawn through the diaphragm 16 and the duct 23, then blown through the nozzle 11 onto the enamel flux A.

The gas jet B which is directed transversely with respect to the lateral surface 14 deflects the path of the projecting portion $A_1$ of the enamel flux towards said surface 14. The enamel powder therefore falls onto said surface at a velocity having an appreciable horizontal component.

When the bath begins to move in rotation so that one end is brought into position vertically beneath the sieve 5, the control unit 42 energizes the electromagnet 26. Armature 27 is then displaced, the rod 25 is set in rotation and the butterfly-gate 24 partially closes the duct 23, the rotation of said rod being limited by the adjustable sector 68.

Said movement of rotation reduces the rate at which the air flows through the nozzle 11 towards the lateral surface 14*a* of the edge 13*a*.

Coating of one end of the bath 12 with enamel is completed after this latter has been rotated through an angle of 180°. The bath 12 then resumes a translational movement in a direction parallel to the longest sides thereof and the edge of the second long side passes directly beneath the sieve 5.

The program of control interrupts the excitation of the electromagnet 26 and the spiral spring 65 returns the butterfly-gate 24 to its initial position. The flow rate of flown air then reverts to its maximum value.

The operations described in the foregoing are repeated when the second end of the bath 12 is brought into position beneath the sieve 5.

The aperture of the diaphragm 16 remains constant while enamelling of the entire edge of the bath is in progress.

In a case, given as a non-limitative example and dealing with enameling of a bath of conventional shape the distances between the outlet 21 of the nozzle 11 and the surface 14 to be enamelled vary between about 300 mm when operating on the long sides of the bath, to 175 mm when operating on the corner edges, the air flow rate varying between from about 2000 $dm^3$ per minute for the long sides to about 1200 $dm^3$ per minute for the corner edges. The corresponding output air velocities are approximately 3 meters per second and 1.8 meter per second, the nozzle outlet 21 being 40 mm high and 280 mm vide.

In same non-limitative example the sieve 5 can be located 100 mm above the plane of the horizontal portion of edge 13. The lower portion of outlet 21 of the nozzle 11 can be located at a distance of approximately 5 mm above said plane of the horizontal portion of the edge 13.

The delivery of enamel is regulated in known manner by means of the vibrator 8. In the non-limitative example herein described, said delivery being in the range of 4 kg/minute depending to a high amount of the product used. The frequency of vibrations being in the range of 2000 to 500 per minute.

During enamelling, the surrounding cold air and hot air which rise from the article involve turbulences and convection movements. These turbulences would strongly perturb the falling enamel flux, in the absence of a conveniently directed gas stream, as provided by the invention.

The tests carried out have shown that the gas stream, on the one hand must be directed at the intersection area of rising cold air and of the hot air. On the other hand, the stream must pass in the vicinity of the vertical center-line of the dusting unit and below said dusting, as hereinbefore stated.

The gas stream must have a speed high enough for cancelling the effects of the rising cold air. Moreover, the stream must be strong enough to be able to turn the enamel flux towards the edge of the article. This explains the above cited numerical values of air flow rate and velocity.

Of course the numerical date given hereinbefore can vary in a large range according to nature and shape and thermal conditions of the sanitary article to be enamelled. In each instance the corresponding data are available to those skilled in the art along the above teaching, the method being of physical nature.

The enamel coating which is deposeted on the edge of the article by means of the method according to the invention is of highly constant thickness by virtue of the uniformity of distribution of enamel over the entire periphery of the article.

The method which is provided by the invention thus permits the manufacture of sanitary articles of satisfying appearance and of the highest quality. In addition, it calls solely for the use of comparatively inexpensive means by virtue of the simplicity of the method and the possibility of carrying out this latter automatically by programming.

The method according to the invention is clearly not limited to what is disclosed in the foregoing, and permits alternative forms, among which can be mentioned the following:

the air-flow can be permitted to remain constant during the enamelling operation, in which case it is only necessary to disconnect the electromagnet 26 whilst the butterfly-gate 24 accordingly remains in the rest position. This alternative arrangement is advantageous for articles to be enamelled which have a regular contour.

In the case of baths or articles having complex shapes, the angular position of the nozzle 11 can be controlled by means of a program which is synchronized with the movements of the article so as to maintain the nozzle outlet 21 at a constant height above the surface to be enamelled.

The jack 18 for adjusting the position of the nozzle 11 can be replaced by a tie-rod system which is known per se and serves to connect said nozzle 11 to the turret 3. If the displacements of the nozzle 11 along a horizontal plane are controlled in dependence on those of the articulated frame 1 in such a manner as to ensure that the distance between the outlet orifice of said nozzle and the surface 14 of the article to be enamelled remains constant, the air-flow can also be maintained at a constant value.

We claim:

1. A method of enamelling the edges of sanitary articles such as baths, in which enamel powder is deposited in a solid state on the article which has previously been heated to a temperature above the melting temperature of the enamel, said edges having a top surface and a lateral surface, wherein a flux of solid enamel powder is caused to fall from a dusting unit onto the edge to be enamelled and also to project outwards therefrom with respect to the vertical line of extension of the lateral surface of the edge, and wherein the projecting portion of said flux is turned towards the lateral surface by blowing thereto a jet of gas which is directed transversely towards said lateral surface and passes in the vicinity of the vertical center line of the enamel flux from the dusting unit and below the latter so as to substantially intersect said flux.

2. A process according to claim 1, wherein the jet of gas is blown by an angularly adjustable nozzle and the corresponding flow of gas is regulated as a function of the distance between the nozzle and the surface to be enamelled.

3. A method as defined in claim 2 and in which the blown jet of gas is air and the article to be enamelled is a bath, wherein the air-flow rate is caused by vary approximately from 1200 to 2000 cubic decimeters per minute and the air-flow velocity is caused to vary from about 1.8 to about 3 meters per second, the distance between the outlet of the nozzle and the surface to be enamelled being correlatively variable within the range of about 175 to about 300 centimeters.

* * * * *